United States Patent [19]

Bixler et al.

[11] Patent Number: 5,064,194

[45] Date of Patent: Nov. 12, 1991

[54] APPARATUS FOR USE IN PRACTICING PITCHING OF BASEBALLS

[76] Inventors: Dickie R. Bixler; Matthew R. Bixler, both of Rte. 1, Box 33, Dacoma, Okla. 73731

[21] Appl. No.: 643,529

[22] Filed: Jan. 18, 1991

[51] Int. Cl.[5] ..... A63B 69/00

[52] U.S. Cl. ..... 273/26 A; 273/29 A; 273/181 A; 273/375; 273/176 B; 273/389; 273/390; 273/402; 273/410

[58] Field of Search ..... 273/26 A, 29 A, 176 B, 273/181 R, 181 A, 181 J, 371, 374, 375, 376, 378, 382, 383, 386, 387, 390, 389, 402, 407, 410, 127 B

[56] References Cited

U.S. PATENT DOCUMENTS

| | | | |
|---|---|---|---|
| 1,116,583 | 11/1914 | Garrison | 273/127 B |
| 1,523,747 | 1/1925 | Bradley | 273/375 |
| 2,040,228 | 5/1936 | Whitley | 273/26 A |
| 2,988,363 | 6/1961 | Hall | 273/181 A |
| 3,000,636 | 9/1961 | Butler, Jr. | 273/181 A |
| 3,122,365 | 2/1964 | August | 273/26 B |
| 3,194,556 | 7/1965 | Vinson | 273/26 A |
| 3,215,432 | 11/1965 | Lee et al. | 273/29 A |
| 3,469,840 | 9/1969 | Kruzel | 273/26 |
| 3,497,218 | 2/1970 | Johnston | 273/26 |
| 3,602,504 | 8/1971 | Chapman et al. | 273/1.5 |
| 4,173,337 | 11/1979 | Olconowski | 273/26 A |
| 4,275,883 | 6/1981 | Grimaldi et al. | 273/26 A |
| 4,563,005 | 1/1986 | Hand et al. | 273/26 |
| 4,655,452 | 4/1987 | Huerstel | 273/26 |
| 4,708,343 | 11/1987 | D'Ambrosio | 273/26 |
| 4,783,070 | 11/1988 | Bauer et al. | 273/26 |
| 4,819,937 | 4/1989 | Gordon | 273/26 |
| 4,846,471 | 7/1989 | Haysom | 273/26 |
| 4,858,921 | 8/1989 | Eustice et al. | 273/26 |
| 4,858,922 | 8/1989 | Santavaci | 273/26 |
| 4,871,169 | 10/1989 | Autorino et al. | 273/26 |
| 4,877,243 | 10/1989 | Taylor | 273/26 |
| 4,915,384 | 4/1990 | Bear | 273/26 |

*Primary Examiner*—Theatrice Brown
*Attorney, Agent, or Firm*—Head & Johnson

[57] ABSTRACT

An apparatus for use in practicing pitching of baseballs to enable the user to improve pitching accuracy and to indicate pitched balls delivered within a strike zone having a vertical backboard with a rectangular opening therethrough, four trapezoidal shaped wings secured to the backboard and serving to form an opening defining a strike zone, each of the wings being pivotal when engaged by a baseball, electrical contacts activated as each trapezoidal wing is pivoted when struck by a baseball and electrical indicators for signaling when a baseball strikes one of the trapezoidal wings to indicate that the baseball has been pitched high, low, inside or outside of the strike zone.

9 Claims, 3 Drawing Sheets

APPARATUS FOR USE IN PRACTICING PITCHING OF BASEBALLS

BACKGROUND OF THE INVENTION

A popular game in the United States, Japan, Cuba and other countries of the world is baseball. Most of the action in a baseball game takes place between a pitcher and a batter. The rules require that the pitcher pitch the baseball within an imaginary strike zone over a plate, termed a "home plate." Any pitch that does not pass through the strike zone is called a "ball" and if four balls are pitched the batter is permitted to first base, thereby putting the batter in play without the requirement of striking the ball. The strike zone is an imaginary rectangular area having a width equal to the width of the home plate, a lower edge that is an imaginary line drawn at the knees of the batter, and an upper edge which is an imaginary line drawn at the shoulders of the batter. Thus, when considering the distance from the pitchers mound to the batters box the strike zone is a relatively small rectangular area through which a ball must pass for a pitch to be effective. A pitcher capable of consistently throwing a ball at a high speed through a strike zone is in great demand by schools and by professional baseball teams. For this reason, a large number of young athletes spend considerable time perfecting baseball pitching skills since the salaries paid for professional baseball pitchers exceed that of most other professions.

In order to help athletes prefect their baseball pitching skills various devices and machines have been invented for their aid and for background reference to machines and other apparatuses used for improving baseball pitching performances, reference may be had to the following U.S. Pat. Nos.: 3,469,840; 4,877,243; 4,871,169; 4,858,921; 4,846,471; 4,819,937; 4,783,070; 4,655,452; 3,602,504; 3,497,218; 4,915,384 and 4,708,343.

SUMMARY OF THE INVENTION

The present disclosure is an apparatus used in practicing pitching of baseballs to enable the user to improve pitching accuracy. The apparatus includes a vertical backboard member having a rectangular opening. The opening is defined by opposed vertical edges and opposed horizontal top and bottom edges.

Pivotally secured to the backboard at the opening are four trapezoidal wing members, termed an "inside" wing member, an "outside" wing member, a "low" wing member and a "high" wing member. The "inside" and "outside" wing members are pivotally affixed to the backboard at the opposed vertical edges of the rectangular opening. The "high" wing member is affixed to the backboard at the upper horizontal edge of the rectangular opening and the "low" trapezoidal wing member is affixed to the backboard at the bottom horizontal edge of the rectangular opening. The four trapezoidal wings each has inside edges and the wing member extend, in normal attitude, in the plane of the backboard. The inside edges of the trapezoidal wings define a strike zone. When a ball is pitched accurately it passes through the strike zone without impinging upon any of the four trapezoidal wings. If a ball is pitched that is too high to be within the strike zone but is at least in the vicinity of the strike zone, the ball impinges against the "high" trapezoidal wing, causing a deflection of the wing that initiates an electrical signal to a strike location indicator to indicate that the pitch was "high". In a similar manner, if the pitch is considered "inside", that is, beyond the strike zone in the direction of an imaginary batter, the ball impinges against the "inside" trapezoidal wing member activating an electrical circuit and an indicator to indicate that the pitch was "inside". In similar manner, pitches that are "low" or "outside" are indicated when the "low" trapezoidal wing member or the "outside" trapezoidal wing member are encountered by a pitched ball.

In the preferred embodiment the backboard includes pivotal panels at each end thereof that can be inclined slightly inwardly and upper pivotal panel that also can be inclined slilghtly inwardly so that when the apparatus is in use a generally concave surface is provided to receive baseballs.

In the preferred embodiment the apparatus is also equipped with wheels adjacent one end and a trailer hitch adjacent the other so that the device can be easily moved from one location to another.

In another preferred embodiment the apparatus includes a pitchback machine configured to collect balls which have passed through the strike zone and return them back to the pitcher. In this way the pitcher is given an incentive to throw strikes since strikes are automatically pitched back to him, whereas pitched balls that do not pass through the strike zone are not pitched back and must be then gathered up by the pitcher. A better understanding of the invention will be had by reference to the following description and claims, taken in conjunction with the attached drawings.

DESCRIPTION OF THE PREFERRED EMBODIMENT

Figure 1:
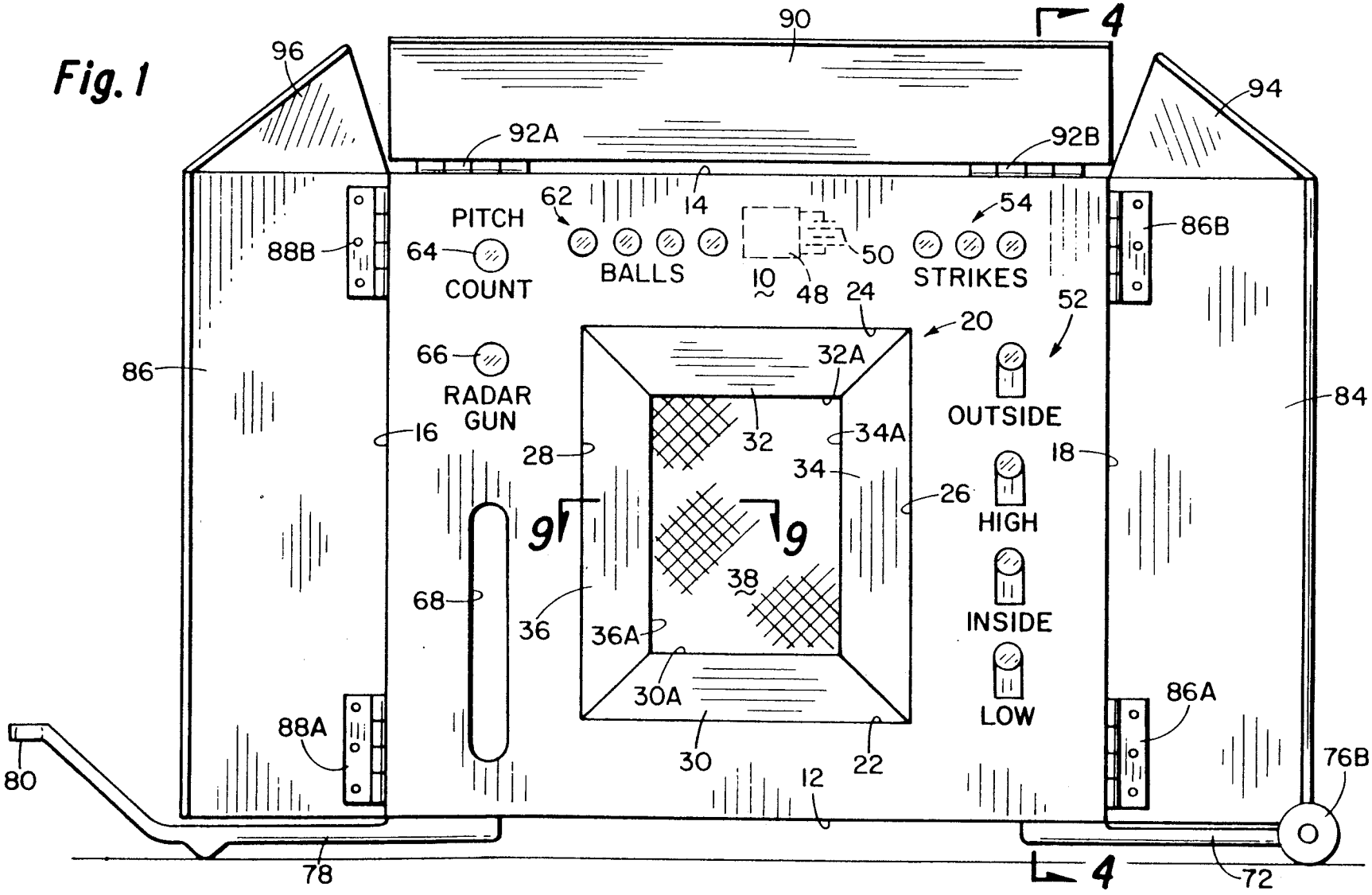
FIG. 1 is a front elevational view of an apparatus for use in practicing the pitching of baseballs to enable the user to improve pitching accuracy. The illustrated apparatus is provided with wheels at one end and a tongue or trailer hitch at the other so that it can be moved from one location to another.
Figure 2:
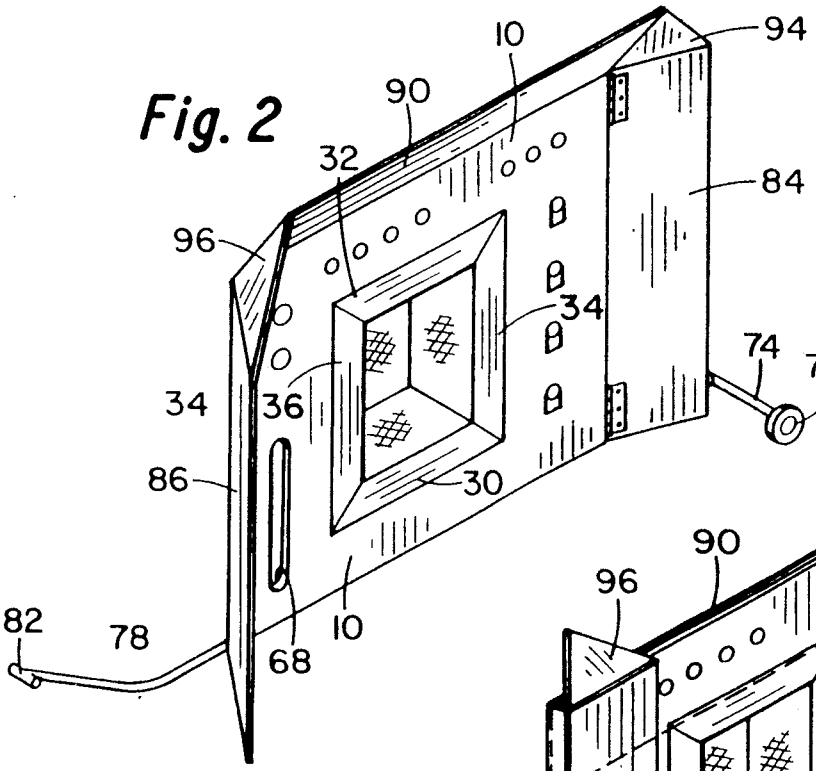
FIG. 2 is a reduced scale isometric of the pitching practice apparatus of FIG. 1.

Referring to the drawings and first to FIGS. 1 and 2, an embodiment of the invention is illustrated. The pitching apparatus includes a vertical backboard member 10 having a bottom edge 12, a top edge 14, a first vertical edge 16 and a second vertical edge 18. The backboard member 10 may be made of metal, wood, plastic or fiberglass and may typically be about six feet high and six to eight long, although these dimensions can vary considerably.

Formed in the backboard is an opening 20 having a bottom horizontal edge 22, a top edge 24, an inside vertical edge 26 and an outside vertical edge 28.

Pivotally affixed to the opening bottom edge 22 is a "low" trapezoidal shaped wing 30. In like manner, pivotally affixed to the opening top edge 24 is a "high" trapezoidal shaped wing 32. Pivoted to the inside vertical edge 26 is an "inside" trapezoidal wing 34 and pivoted to the backboard at the vertical edge 28 is an "outside" trapezoidal shaped wing 36.

The "low" wing 30 has an inner edge 30A, and in like manner "high" wing 32 has an inner edge 32A; "inside: wing 34 has an inner edge 34A, and "outside" wing 36 has an inner edge 36A. The inner edges 30A, 32A, 34A and 36A define an opening 38 that is dimensioned to conform to a typical strike zone, that is, the horizontal spacing between the vertical edges 34A and 36A is equal to that of the width of a home plate as prescribed by baseball rules. The bottom 30A is of a height typical of the strike zone that is approximately that of the height of the knees of a typical batter, and top edge 32A is of the height of the shoulder height of the typical batter. When used for pitching practicing, a ball passing through opening 38 is considered a "strike", whereas any ball which does not pass through opening 38 is considered a "ball."

Figure 9:
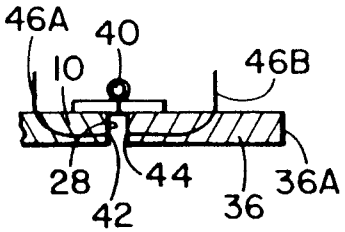
FIG. 9 is a fragmentary cross-sectional view as taken along the line 9—9 of FIG. 1 showing the pivotal arrangement of the "outside" trapezoidal wing secured to the backboard member and showing one means of providing an electrical signal for use in indicating an outside pitch when a pitched ball impinges against the outside trapezoidal wing. The same indicating means is employed for the other three trapezoidal wings.

As previously stated the wing member 30, 32, 34 and 36 are each pivotally affixed to backboard 10 and FIG. 9 shows one means of such pivotal affixation. A hinge 40, that preferably is of the type that has an integral spring, is secured to the outside trapezoidal shaped wing member 36 and to the backboard member at the edge 28. The spring within hinge 40 serves to keep the outside trapezoidal wing member 36 in alignment with backboard member 10, that is, in the same plane as the backboard member.

Means is provided for indicating when wing member 26 is pivoted with respect to backboard 10. This can be accomplished in a variety of ways but in one method illustrated an electrical contact 42 is secured to the backboard opening outside edge 28 and an electrical contact 44 is secured to the vertical edge of outside trapezoidal wing member 36. When wing member 36 is in alignment with backboard 10 the electrical contacts 42 and 44 engage each other but if the wing member 36 is pivoted with respect to backboard 10, the contact is broken. By means of conductors 46A and 46B a signal is provided when continuity is broken between electrical contacts 42 and 44.

As shown in FIG. 1 in dotted outline, there is affixed to the rearward surface of backboard 10 an electronic control box 48 powered by a battery 50. Conductors 46A and 46B extend to the electronic control box 48.

Figure 6:
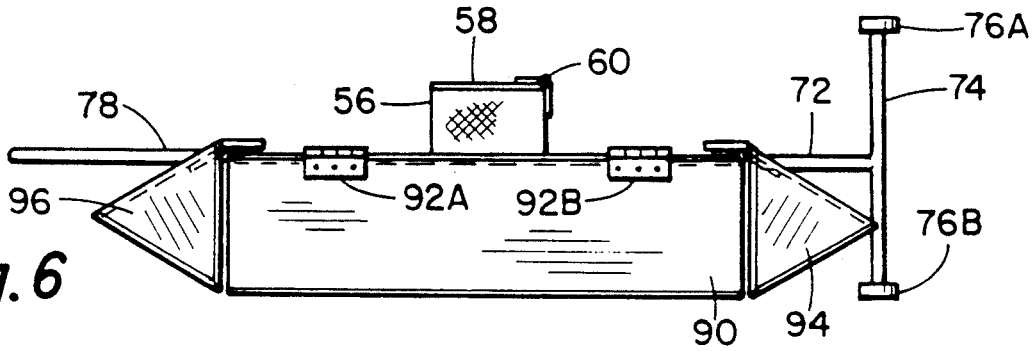
FIG. 6 is a reduced scale top view as in FIG. 1, with the side panels and top panel in the position they occupy when the apparatus is being used for pitching practice.

On the face of backboard member 10 are a panel of four indicators, generally indicated by the numeral 52. These indicators, that preferably are in the form of lights, serve to indicate when a pitch is "low", "inside", or "outside". Indicators 52 are activated by electronic control 48 in response to movement of the trapezoidal shaped wing members 30, 32, 34, and 36. These wing members move when struck by a pitched ball. For instance, if a pitched ball strikes the outside wing member 36, the wing member will be inwardly pivoted, breaking continuity between electrical contacts 42 and 44 as shown in FIG. 9, to thereby provide a signal that by operation of the electronic circuitry within control box 48 will turn "on" momentarily the "outside" light making up the pitch indicator 52. In like manner, if a ball impinges on "high" wing member 32, deflecting it slightly inwardly, electrical contacts will be broken and the light indicating a "high" pitch will be momentarily lit. When the "inside" wing member 34 is struck by a pitched ball, thereby momentarily deflecting it inwardly, the "inside" light is illuminated. When the "low" wing member 30 is struck by a pitched ball, the "low" indicator light is momentarily lit. Thus, when a pitcher pitches a ball that passes through the strike zone, that is, within opening 38, none of the pitch indicators 52 are lit. Instead, a strike indicator light 54 is illuminated. A strike can be indicated in a plurality of ways. For instance, in FIGS. 6 and 7, a strike catcher box 56 is affixed to the rearward surface of backboard member 10. The strike catcher box 56 has a door 58 held in place by hinge 60. When a ball passes through the strike zone opening 38 it impinges on door 58 to momentarily break an electrical contact (not shown, but similar to that of FIG. 9) to indicate that a strike has been pitched:

In addition to indicating strikes by strike indicator 54, when one of the wing members 30, 32, 34, or 36 is engaged by a pitched ball to activate one of the pitch indicators 52, the electrical control 48 also activates a set of ball indicator lights 62. Thus, the pitcher knows by the indicating lights 56 and 62 the number of strikes and balls which result in the imaginary batter either being "struck out" when three strikes are indicated by strike indicator 54 or "walked" as indicated by four balls on the indicator 62. In the event of the occurrence of either three strikes or four balls, the circuity in control 48 functions to reduce both the strike and ball indicators to zero, indicating a new imaginary batter.

The circuity of control 48 can be designed to provide other indications, such as a total pitch count indicator 64. To provide a highly sophisticated pitching device the apparatus may be equipped with a radar gun, displaying the speed of a pitched ball at indicator 66.

Figure 8:
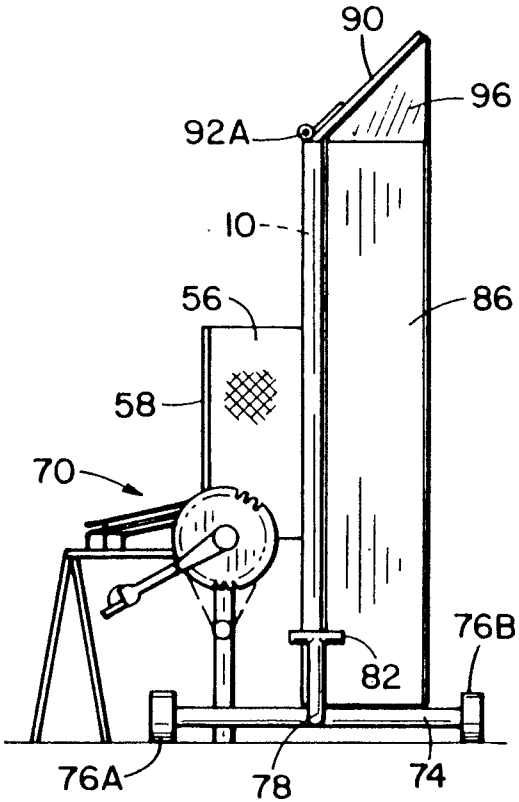
FIG. 8 is an elevational view of the apparatus as seen in FIG. 1 but showing the use of a ball pitchback machine for returning balls to the pitcher that have passed through the strike zone. The pitchback machine is not shown in FIG. 6 and 7.
Figure 4:
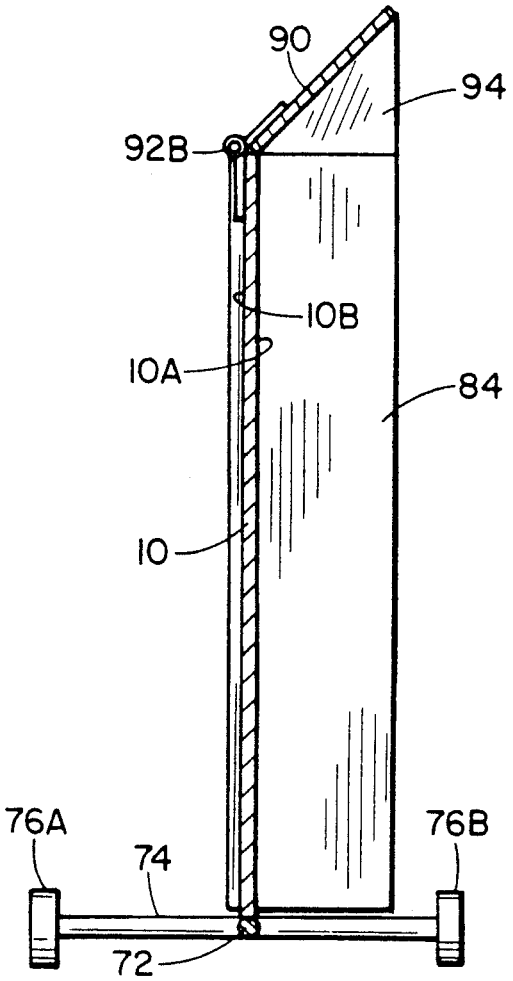
FIG. 4 is an elevational cross-sectional view taken along the line 4—4 of FIG. 1 and showing one end panel and the top panel in the position they occupy during use of the apparatus by a practice pitcher.

As shown in FIG. 1, backboard member 10 has an elongated vertical opening 68 therein termed a "pitchback opening." In one embodiment as illustrated in FIG. 8, the pitching practice apparatus includes a pitchback machine, generally indicated by the numeral 70. When a ball passes through strike zone opening 38 and enters strike catcher box 56, the ball moves automatically downwardly to pitchback machine 70. Such machines are well known and frequently employed in pitching or batting practice devices and function to manipulate an arm that picks up a ball and throws it through pitch back opening 68. In this way the pitcher has increased incentive to throw strikes since the balls that pass through opening 38 are automatically returned, whereas balls that do not pass through the opening are not conveyed to the pitchback machine 70 and the pitcher must physically gather up the balls that bounce off of the front of backboard member 10.

Figure 3:
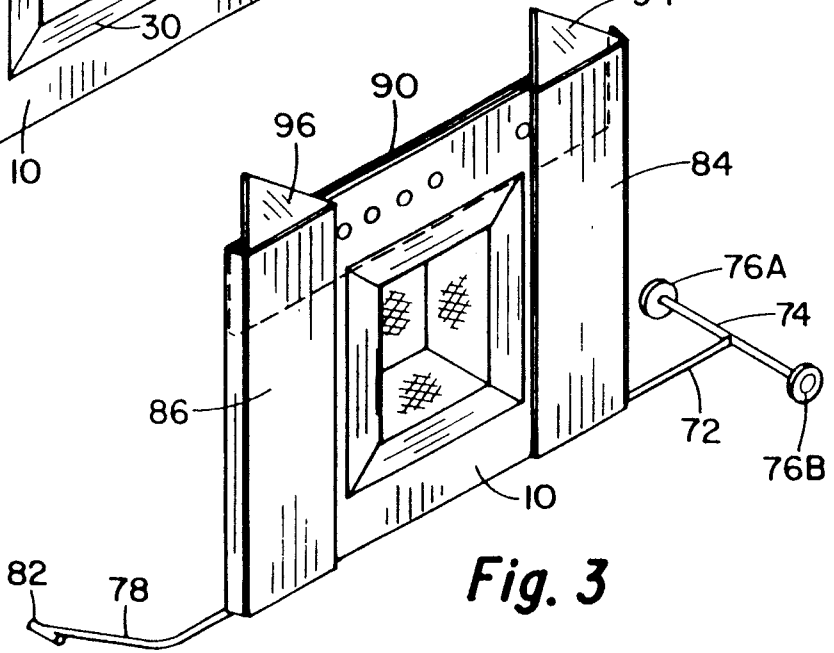
FIG. 3 is an isometric as in FIG. 2 but showing the end panels and top panels folded in position for transporting the pitching practice apparatus.

The pitching practice apparatus of this disclosure is portable. For this reason there is attached to backboard member 10, adjacent the rearward vertical edge, a structural member 72 that supports, at the outer end thereof, an axle 74 having wheels 76A and 76B at each end thereof. At the backboard member forward vertical edge 78 a structural member 78 has, at the outer end thereof as shown in FIG. 1, a trailer hitch 80. Thus, in the embodiment of FIG. 1 the entire pitching practice device can be attached to a vehicle and moved by means of wheels 76A and 76B from one location to another. Instead of a trailer hitch 80, there may be merely attached to the structural member 78 a handle 82 as shown in FIGS. 2 and 3. In the embodiment of FIGS. 2 and 3 the apparatus is moved manually from one location to another. Wheels 76A and 76B are shown relatively small. When the device is designed to be moved long distances by being pulled behind a vehicle, such as a car, pick-up or the like, then wheels 76A and 76B must naturally be much larger to accept highway speeds.

To improve the usefulness of the pitching practice device and to reduce the possibility of pitched balls going beyond the device, in the embodiment illustrated in the drawings, there is attached to the backboard member vertical edge 18 a first vertical panel 84 pivotally supported by hinges 86A and 86B. In like manner, pivotally affixed to the backboard member vertical edge 16 is a second vertical panel 86 supported by hinges 88A and 88B.

Pivotally supported to the backboard member top edge 14 is a top horizontal panel 90 attached by hinges 92A and 92B.

When the pitching practicing apparatus is in use vertical panels 84 and 86 are inclined inwardly, and the top panel 90 is also inclined inwardly to provide a generally a concave area to receive pitched balls. To complete the concave configuration a triangular shaped wing portion 94 is affixed to the upper edge of first vertical panel 84, and a triangular portion 96 is affixed to the upper edge of the second vertical panel 86. As shown in FIG. 2, when panels 84, 86 and 90 are pivoted forwardly they fit together to form a generally concave pitch receiving area.

Figure 5:
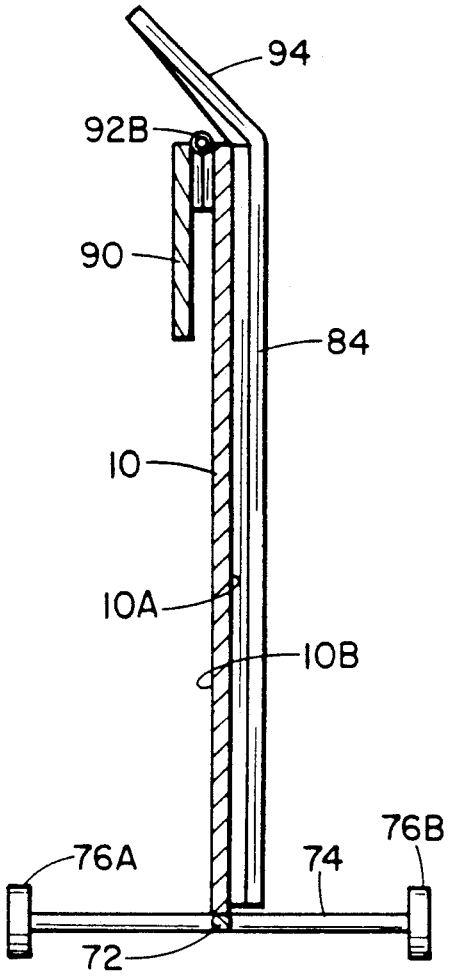
FIG. 5 is a cross-sectional view as in FIG. 4 but showing an end panel and the top panel folded for transporting the apparatus.
Figure 7:
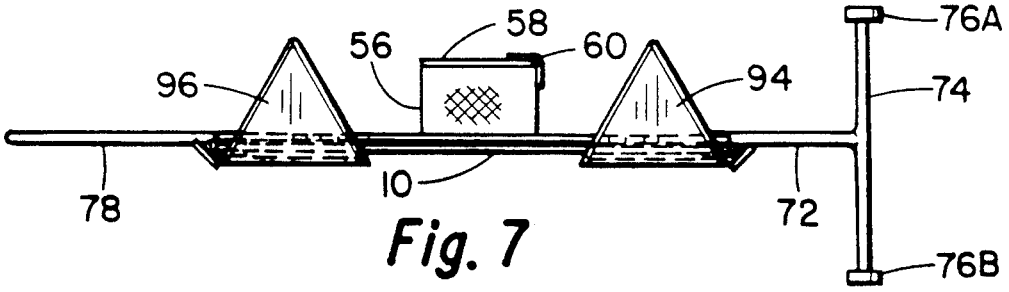
FIG. 7 is a top view as in FIG. 6 but showing the side panels and top panel positioned for movement of the apparatus.

In order to facilitate transporting the device panels 84, 86 and 90 can be pivoted to stored positions, as shown in FIGS. 3, 5, and 7. Referring specifically to FIG. 5, backboard member 10 has a forward vertical surface 10A and a rearward vertical surface 10B. When in the stored or transportable position vertical panels 84 and 86 are folded so that they are parallel and contiguous to the backboard member forward vertical surface 10A, and the top horizontal panel 90 is pivoted to lie parallel to and adjacent the backboard member rearward vertical surface 10B. In this arrangement, side panels 84 and 86 and top panel 90 reduce the total area of the device and therefore the wind resistance to increase mobility of the pitching practice apparatus when being pulled behind a vehicle.

The pitching practice apparatus thus described provides a convenient system for use by a pitcher to practice throwing pitches. In typical use the pitcher will set up the pitching practice device as it appears in FIG. 2 and will stand at a distance equal to the pitching distance between the pitching mound and the home plate as prescribed by baseball rules. The pitcher will then throw a sequence of baseballs, striving to pitch through the opening strike zone 38. On the other hand, the pitcher can also practice pitching balls that are "inside"-the strike zone or "outside" the strike zone, or "high" or "low" relative to the strike zone by intentionally attempting to pitch balls that strike wing members 30, 32, 34 or 36. The device has the advantage of indicating to the pitcher when he has pitched a strike or when he has pitched a ball that is near the strike zone but which is "inside", "outside", "high" or "low".

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many chages may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An apparatus for use in practicing pitching of baseballs to enable the user to improve pitching accuracy and to indicate pitched balls delivered within a strike zone, comprising:

a vertical backboard member having a rectangular opening therethrough conforming in width defined by an inside vertical edge and an outside vertical edge and in height defined by a horizontal top edge and a horizontal bottom edge to simulate a typical strike zone as employed in the game of baseball;

means to impede a baseball after it has passed through said opening;

means attached to said backboard adjacent said opening inside vertical edge to detect the impingement of a baseball thereagainst and for indicating an "inside" pitch;

means attached to said backboard adjacent said opening outside vertical edge to detect the impingement of a baseball thereagainst for indicating an "outside" pitch;

means attached to said backboard adjacent said opening top horizontal edge to detect the impingement of a baseball thereagainst for indicating a "high" pitch; and means attached to said backboard adjacent said opening bottom horizontal edge to detect the impingement of a baseball thereagainst for indicating a "low" pitch.

2. A pitching practice apparatus according to claim 1 including means to indicate the number of pitched balls passing through said opening to thereby indicate the number of pitched balls deemed to be strikes and means to indicate the number of pitched balls impinging on one of said inside pitch, outside pitch, low pitch and high pitch means to indicate the number of pitches deemed to be balls.

3. A pitching practice apparatus according to claim 2 including means to count the total number of pitches comprising the total of pitches deemed to be strikes plus the total pitches deemed to be balls.

4. A pitching practice apparatus according to claim 1 including means to measure the speed of travel of balls pitched.

5. A pitching practice apparatus according to claim 1 including means to pitch back to the user balls that pass through said opening.

6. A pitching practice apparatus according to claim 1 wherein said backboard member has a front and a back vertical surface, a left and a right vertical edge and a horizontal top and bottom and including:

a first generally rectangular side panel hinged to said backboard member left vertical edge; and a second generally rectangular side panel hinged to said backboard member right vertical edge, said first and second side panels being each pivotal to an operating position to extend the length of said backboard member and pivotal to a storage position to extend parallel and contiguous to said backboard member.

7. A pitching practice device according to claim 6 including:

a generally rectangular top panel member hinged to said backboard member top horizontal edge and pivotal to a forward operating position to extend the height of said backboard member and pivotal to a storage position to extend parallel and contiguous to said backboard member.

8. A pitching practice device according to claim 7 wherein said side panels each have thereon wing portions which, when said side panels and top panel are pivoted to operating positions of substantially equal obtuse angles with respect to said backboard member to thereby form a generally concave surface area to receive pitched balls.

9. A pitching practice apparatus according to claim 1 wherein said backboard member has a bottom generally horizontal edge and a left and a right vertical edge and including:

wheel means secured to said backboard member adjacent one of said left and right edges; and trailer hitch means secured to said backboard member adjacent the other of said left and right edges, said wheel means and trailer hitch means serving, when said trailer hitch means is secured to a vehicle, to support said bottom edge of said backboard means aboveground level to thereby permit said pitcher practice apparatus to be pulled from one location to another.

* * * * *